US006398673B1

(12) United States Patent
Maruca

(10) Patent No.: US 6,398,673 B1
(45) Date of Patent: Jun. 4, 2002

(54) BASKETBALL GAME APPARATUS

(76) Inventor: John Maruca, 17646-B Jamestown Way, Lutz, FL (US) 33549

( * ) Notice: Subject to any disclaimer, the term of this patent is extended or adjusted under 35 U.S.C. 154(b) by 0 days.

(21) Appl. No.: 09/507,430

(22) Filed: Feb. 19, 2000

Related U.S. Application Data

(60) Provisional application No. 60/121,380, filed on Feb. 24, 1999.

(51) Int. Cl.[7] ..... A63B 63/08

(52) U.S. Cl. ..... 473/481; 473/415; 482/40

(58) Field of Search ..... 473/415, 447, 473/472, 479, 481, 482, 487, 488; 273/400; 482/40, 55

(56) References Cited

U.S. PATENT DOCUMENTS 3,901,506 A * 8/1975 Caveney ..... 473/433
3,995,565 A * 12/1976 Kersey ..... 410/151
4,036,494 A * 7/1977 Hayes ..... 473/481
4,587,757 A * 5/1986 Lirette ..... 43/21.2
5,221,240 A * 6/1993 Mann et al. ..... 482/40

* cited by examiner

*Primary Examiner*—Paul T. Sewell
*Assistant Examiner*—M. Chambers
(74) *Attorney, Agent, or Firm*—David Kiewit

(57) ABSTRACT

A hoop-toss game simulative of basketball has a backboard assembly consisting of a backboard, a basketball hoop attached to the backboard whenever it is in use, and a horizontally disposed extensible frame. A central portion of the frame is fixedly attached to the backboard. Two side portions of the frame have rails that are telescopically attached to the central portion. Each of these side portions is biased by associated springs into an expanded position in which the apparatus is held between the vertical walls or jambs of a doorway.

1 Claim, 4 Drawing Sheets

BASKETBALL GAME APPARATUS

CROSS REFERENCE TO RELATED APPLICATIONS—NOT APPLICABLE

This application claims the filing priority of U.S. Provisional Application for Patent No. 60/121,380, filed Feb. 24, 1999

STATEMENT REGARDING FEDERALLY SPONSORED RESEARCH OR DEVELOPMENT: NOT APPLICABLE

Not Applicable

BACKGROUND OF THE INVENTION

1. Field of the Invention

The invention relates to a hoop-toss game of skill simulative of the game of basketball. More particularly, the invention relates to a basketball backboard and hoop assembly that may be used indoors by children.

2. Background Information

Many different arrangements have been used to set up a basketball, or basketball-simulative, hoop and backboard. Of particular interest to the present invention are reduced-scale basketball-simulative hoop and backboard arrangements generally intended for indoor play by children who may use a small, soft polymeric foam ball. Notable in the prior patent art in this field are:

U.S. Pat. No. 5,827,136, wherein Halter et al. teach a basketball target mounted to a door by means of adjustable straps that accommodate variations in both door width and mounting height. Their target includes at least one hoop that can be pivoted up against the backboard. Halter et al.'s target, because it requires someone to reach up to the top of a door when installing it over the door, generally requires an adult to be present whenever a small child is to play the game.

U.S. Pat. No. 5,570,879 wherein Glancey et al. describe a variety of sports targets that are intended to be mounted on someone's body and carried about—e.g., for crowd participation entertainment purposes during breaks in sporting events. Several of these targets are supported on ladder like frames or provide a telescopic adjustable for height.

U.S. Pat. No. 4,657,249, wherein Offutt teaches a door-mounted basketball game providing for height adjustment. Inasmuch as Offutt's bracket mounts either to the top or to the bottom of the door, there is no need for width adjustment.

U.S. Des. 302,575, wherein Parrish shows a decorative indoor basketball target having two flat elongated loops extending horizontally across the back of the backboard. These loops appear to be intended to be used to mount the backboard to a door by slipping the loops over the top of the door.

Several U.S. patents unrelated to ball games provide teaching of structures showing features analogous to those of present invention. Notable among these are:

U.S. Pat. No. 3,995,565, wherein Kersey teaches an extensible ladder-like structure intended for use as a cargo brace in the load bed of a truck. Kersey's structure comprises a pair of inner rails slidably and telescopically mounted within a pair of spaced outer rails. Tension springs are mounted within each outer rail and are arranged so as to bias the inner rails into a retracted position within the outer rails. A separate ratchet means is provided to extend the inner rails outwardly into positive engagement with the walls of the load bed.

U.S. Pat. No. 2,532,909, wherein Hart shows a spring-loaded clothes bar comprising two telescopically intermitted rods and a compression spring biasing the composite clothes bar into an extended state.

U.S. Pat. No. 1,639,551, wherein Booth presents a spring-loaded curtain rod comprising an inner rod telescopically and slidably interfitted into an outer rod. A compression spring biases the curtain rod into an extended position.

BRIEF SUMMARY OF THE INVENTION

A preferred embodiment of the apparatus of the invention provides a basketball backboard assembly consisting of at least a backboard, a basketball hoop attached to the backboard whenever it is in use, and a horizontally disposed extensible frame having a central portion fixedly attached to the backboard and having two side portions. Each of these side portions is biased by associated springs into an expanded position in which the apparatus is held between the vertical walls or jambs of a doorway.

It is an object of one embodiment of the invention to provide a basketball backboard that is removably mountable within a doorway, and that can preferably be mounted in the doorway regardless of whether the door is open or closed. It is an additional specific object of the invention to provide a removable backboard that can be mounted within a doorway, or removed therefrom, by a child who is too short to reach the top of the door.

It is a further object of some embodiments of the invention to provide apparatus for a hoop-toss game simulative of the game of basketball, where the apparatus comprises a backboard assembly having a basketball hoop attached thereto, and wherein the method of attaching the hoop to the backboard is such that the assembly can be stored in a rectangular box having a length comparable in size to a width of a doorway, a width slightly larger than the height of the backboard, and a thickness substantially smaller than the diameter of the hoop. In a first specific embodiment of the invention, the hoop is removed from the backboard before the assembly is placed in the box. In a second specific embodiment, the hoop is hingedly attached to the backboard so that it can be folded flat against the backboard when the assembly is placed in the box.

Although it is believed that the foregoing recital of features and advantages may be of use to one who is skilled in the art and who wishes to learn how to practice the invention, it will be recognized that the foregoing recital is not intended to list all of the features and advantages. Moreover, it may be noted that various embodiments of the invention may provide various combinations of the hereinbefore recited features and advantages of the invention, and that less than all of the recited features and advantages may be provided by some embodiments.

DETAILED DESCRIPTION OF THE INVENTION

Figure 1:
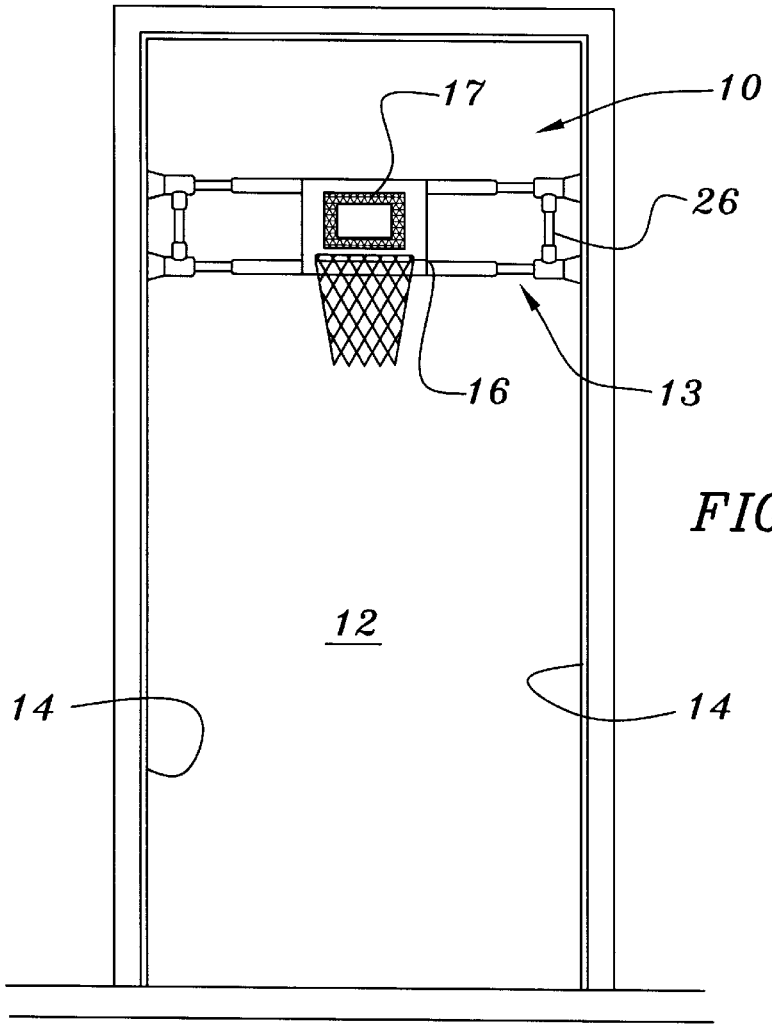
FIG. 1 is an elevational view of an apparatus of the invention mounted within a doorway.

Turning now to FIG. 1, one finds a depiction of a backboard assembly 10 of the invention installed within a doorway 12 comprising two vertically extensive walls or doorjambs 14. Although the backboard assembly 10 is shown as being mounted within an upper portion of the doorway 12 by means of an extensible frame 13, it will be clear from the following discussion that this depiction is arbitrary and that the backboard assembly 10 can be mounted at any selected height within the doorway. Moreover, although the preferred depicted backboard is relatively small, as is the depicted hoop 16, it will be recognized that a wide variety of heights and widths can be selected for either of these components. The depicted backboard assembly 10 clearly appears too small to be used with a regulation ball. Like other children's hoop-toss or basketball-simulative games it is expected to be used with a small, rubber or polymeric foam ball having a diameter slightly smaller than that of the depicted hoop, where it is expected that the hoop will be seven to ten inches in diameter in most cases.

Figure 2:
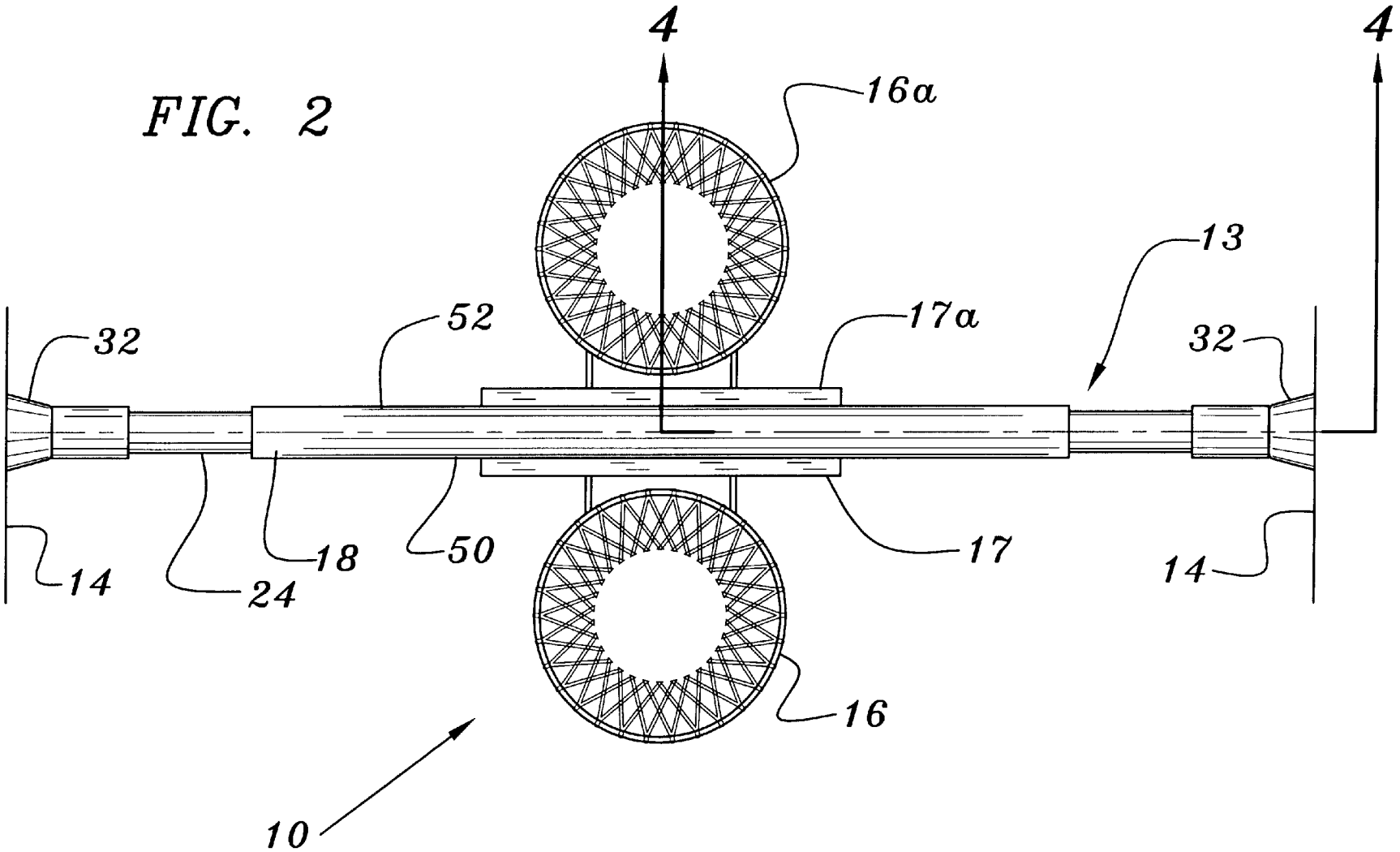
FIG. 2 is a plan view of the arrangement depicted in FIG. 1.
Figure 3:
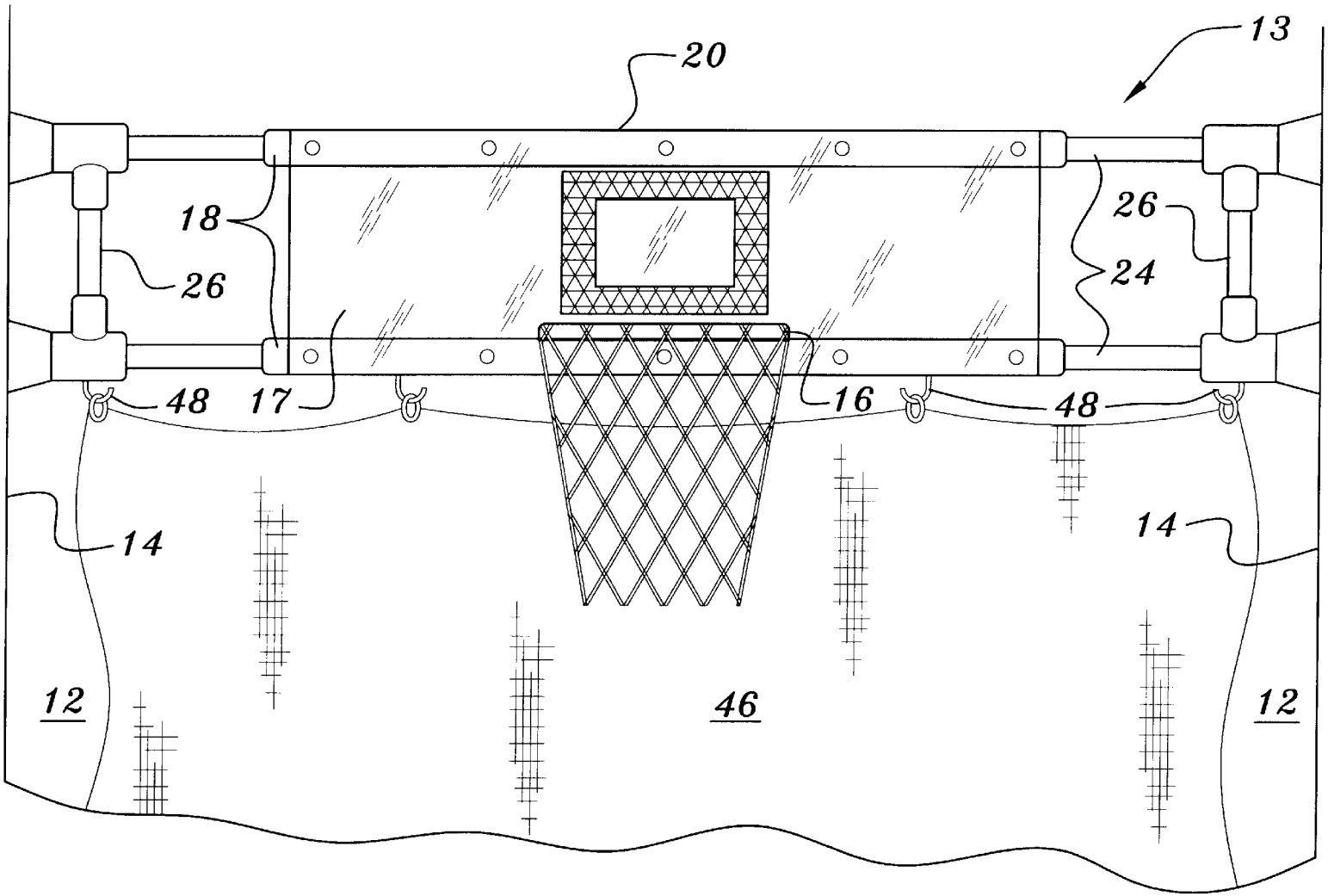
FIG. 3 is a detail view of the apparatus similar to that of FIG. 1, but having an optional drop net suspended beneath a backboard.
Figure 5:
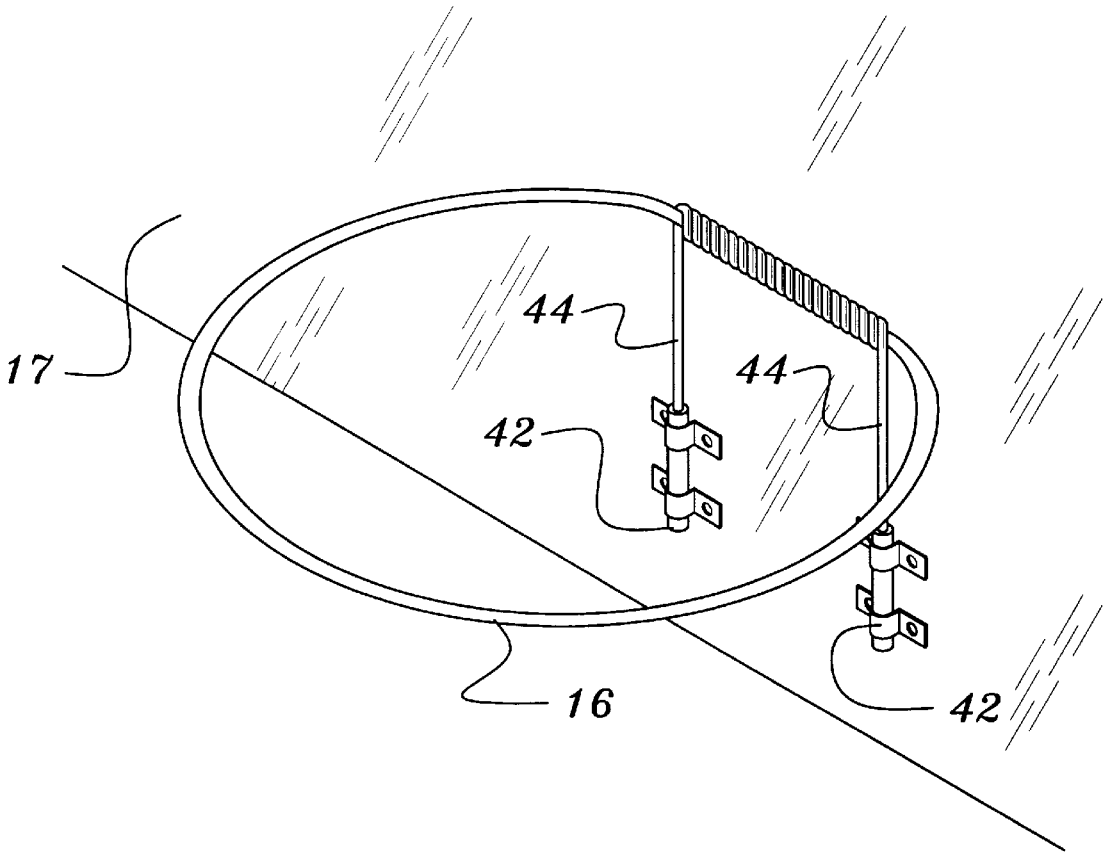
FIG. 5 is a detail view showing an arrangement for attaching a basketball hoop to the backboard.

A geometrically central portion of the preferred backboard assembly comprises a backboard 17 having two parallel outer rails 18, which are preferably round tubular members, fixedly attached to the board in a spaced apart relationship in which one of the outer rails is adjacent the top 20 and the other of the outer rails is adjacent the bottom edge 22 of the board. On either side of the central portion of the preferred assembly, a ladder-like pair of parallel inner rails 24 is inserted into the respective ends of the outer rails 18 in a telescoping relationship. In a preferred embodiment, each pair of inner rails has an associated rung-like member 26 extending therebetween. It may be noted that various heights and widths may be used for the backboard 17 and that the backboard 17 may be configured to be largely coextensive in width with the outer rails 18 (e.g., as depicted in FIG. 3, or may be substantially narrower (e.g., as depicted in FIG. 2).

Figure 4:
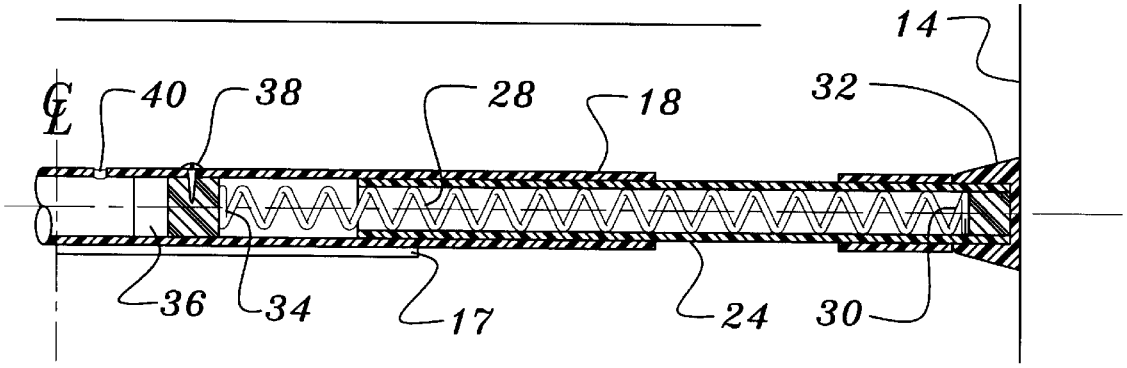
FIG. 4 is a cross-sectional view taken as indicated by the double-headed arrow 4—4 in FIG. 2.

As depicted in FIG. 4, a coil spring 28 may be inserted into each of telescoped set of inner and outer rails 29. An outboard end 30 of the coil spring 28 may be restrained by an end cap 32 on the inner tube. In a preferred embodiment, the inboard end 34 of the spring 28 is retained by an adjustable plug 36 that may be held by a set screw 38, or other suitable means, that can be inserted through a selected one of a plurality of holes 40 spaced along the length of the tubes 29. Providing a set of positions at which the inboard end 34 of the spring 28 can be retained allows a user to adjust the apparatus to fit within a selected door. If no such spring adjusting arrangement were supplied, and if the spring were chosen to hold the backboard within a fairly wide doorway (e.g., one having a width of thirty three inches), a user might find it difficult to compress the springs far enough to allow the apparatus to be squeezed into a substantially narrower (e.g., twenty four inch) doorway. Although a preferred embodiment uses four coil springs, with one located respectively within each set of telescoping tubes, it will be clear to those skilled in the art that other sorts of spring arrangements could be used. For example, one could use a single long coil spring in each of the top and bottom tube assemblies 29, or one could use a pneumatic arrangement of the sort commonly called "air springs" and widely used in automotive applications.

Although the preferred embodiment uses round telescoping tubes, it will be recognized that many other approaches may be used to provide a backboard assembly 10 having one or more springs biasing the outboard portions of the assembly against fixed vertical surfaces, such as a pair of door jambs 14. Moreover, although the preferred embodiment is arranged with the outer tubes 18 of a telescoped set 29 thereof attached to the backboard 17 and the inner tubes 24 of the telescoped arrangement associated with the expandable outboard portions of the assembly 10, it will be clear to those skilled in the art that one could equally well choose to have the outer tubes 18 associated with the outboard portions and have the inner tubes 24 fixedly attached to, and suitably spaced away from the backboard 17.

In a preferred embodiment, a pair of vertically disposed hoop-mounting tubes 42 are attached to the front of the backboard and a cooperating pair of rods 44 or wires that depend from the hoop 16 are inserted thereinto to fasten the hoop 16 to the backboard 17. In some embodiments, the hoop assembly may comprise a hinged attachment to the backboard and may further comprise a hoop spring associated with the hinged attachment so as to bias the hoop into its normal position for play while allowing one to fold the hoop against the backboard so that the backboard assembly can be stored in a box having one side that is only slightly longer than the sum of the thicknesses of the actual backboard and of the rail assembly attached to the back thereof.

In some embodiments of the invention, as depicted in FIG. 3, a long flexible sheet of material 46, which may be netting, is suspended from one of the telescoping tubes by means of hooks 48, or other suitable attachments. The long sheet of netting 46 is used to fill in empty doorway and prevent balls that are thrown too low from going through the doorway into another room. This netting is not expected to be needed when the game is plated in a doorway having a door that can be closed behind the backboard.

In some embodiments of the game apparatus, a backboard 17*a* and a second hoop 16*a* may be provided on the back of the apparatus 10 so that two players, in adjacent rooms, can play with the same backboard set placed in a doorway linking the two rooms. In this case a first side 50 of the extensible frame 13 is fixedly attached to the back surface of a first backboard 17 and the second side 52 of the extensible frame 13 is fixedly attached to the back surface of the second backboard 17*a* so that the frame 13 is sandwiched between the two backboards 17, 17*a*.

It may be noted that although the preferred embodiment of the invention is configured to be placed in a doorway with the support rails extending horizontally, it would be possible to make an equivalent structure comprising long springably biased supports that extended from the top to the bottom of a doorway. Clearly, the preferred version uses less material and is easier to handle and to store than is this suggested vertically disposed version.

Although the present invention has been described with respect to several preferred embodiments, many modifications and alterations can be made without depairing from the invention. Accordingly, it is intended that all such modifications and alterations be considered as within the spirit and scope of the invention as defined in the attached claims.

What is claimed is:

1. An apparatus for a hoop toss game, the apparatus comprising a backboard assembly comprising:

an extensible frame having a first side and a second side, the frame comprising:

a first horizontal pair of parallel rails spaced apart from each other;

a second pair of parallel rails, each of the second rails slidably interfitted with a respective one of the first rails, the second pair of rails adapted to move between an extended position and a retracted position;

a pair of springs adapted to bias the second pair of rails into the extended position, each of the springs operatively disposed between one of the first rails and that one of the second rails with which it is interfitted; and first and second backboards, each of the backboards having a respective front surface having a respective hoop attached thereto and a respective back surface, wherein the back surface of the first backboard is fixedly attached to the first side of the extensible frame and the back surface of the second backboard is fixedly attached to the second side of the extensible frame so as to be parallel to and coextensive with the first backboard.

* * * * *